US005478139A

United States Patent [19]

Scott

[11] Patent Number: 5,478,139

[45] Date of Patent: Dec. 26, 1995

[54] MOBILE DIGGING/CUTTING SYSTEM

[75] Inventor: Paul J. Scott, Shreveport, La.

[73] Assignee: Rockmaster Equipment Manufacturing, Inc., Shreveport, La.

[21] Appl. No.: 66,212

[22] Filed: May 25, 1993

[51] Int. Cl.[6] ..... E21C 25/08; E21C 27/24

[52] U.S. Cl. ..... 299/76; 37/403; 299/78

[58] Field of Search ..... 299/73, 75, 76, 299/78, 87, 39, 89; 404/90; 37/403

[56] References Cited

U.S. PATENT DOCUMENTS

| | | | |
|---|---|---|---|
| 3,730,593 | 5/1973 | Karlovsky, Jr. | 299/76 |
| 3,779,408 | 12/1973 | Ivie | 37/403 X |
| 3,860,291 | 1/1975 | Rauch et al. | 299/76 X |
| 4,648,660 | 3/1987 | Mann et al. | 299/78 X |
| 4,785,560 | 11/1988 | Hanson | 299/67 X |
| 4,852,277 | 8/1989 | Ward | 37/403 X |

*Primary Examiner*—David J. Bagnell
*Attorney, Agent, or Firm*—Jay M. Cantor

[57] ABSTRACT

A system for crushing a wall of rock comprising a first device, such as a track hoe, for moving with at least two degrees of freedom, a second device, such as an articulating boom, secured to and moving with the first device for moving with at least two degrees of freedom, one of the two degrees of freedom of the second device being different from the two degrees of freedom of the first device. A rotating stone cutting mechanism is secured to the second device, the stone cutting mechanism comprising a rotating drum having a plurality of tooth holders on the surface thereof in a helical array relative to the axis of the drum, each of the tooth holders having a very hard tooth, preferably of a refractory carbide, releasably secured thereto. A motive structure causes rotation of the drum about its axis. The motive structure includes a motor, preferably hydraulic, a sprocket driven by the motor, a chain and a second sprocket coupled to the drum.

20 Claims, 2 Drawing Sheets

MOBILE DIGGING/CUTTING SYSTEM

BACKGROUND OF THE INVENTION

1. Field of the Invention

This invention relates to a system, preferably mobile, for cutting and pelletilizing walls of rock and the like.

2. Brief Description of the Prior Art

Cutting and removal of rock, primarily but not limited to a wall of rock, has, in the past, been limited to blasting and ripping down the stone with subsequent passage of the blasted stone through a crushing machine to provide smaller pieces. In particular, such methods are presently used in the mining of glaucunite, a material used for secondary roads or as a road base for primary roads which is considered the leading building material in many regions. The primary desirability of glaucunite is that it is an oil lacerated rock and therefore does not create dust when a vehicle travels thereover.

Such prior art techniques are dangerous in that blasting requires the use of dangerous instrumentalities and are relatively costly since blasting expertise is required and the blasted rock must subsequently be further crushed to provide pellets of desired dimension.

Rotary cutting units have been known in the prior art. Examples thereof are shown in U.S. Pat. Nos. 4,858,347, 4,785,560 and 3,779,408. None of these patents, however, relate to rock or the cutting of materials of similar hardness.

SUMMARY OF THE INVENTION

In accordance with the present invention, there is provided a system which is mobile and capable of breaking down and pelletilizing walls of rock with the resulting pellets being of small size and often being usable without further crushing as required with the prior art rock blasting techniques.

Briefly, there is provided a standard articulating boom, to which the rotating stone cutter of the present invention is secured. The articulating boom is secured to a standard track hoe, the cutter being powered by the track hoe hydraulic system.

The boom positions the cutter against a rock wall or the like under operator control from the track hoe in two dimensions or with two degrees of freedom. The cutter positioning is further accomplished by movement of the track hoe controlling and holding the articulating boom in two horizontal dimensions or with two degrees of freedom, one of which is different from the two degrees of freedom provided by the boom movement to provide movement in a vertical and a horizontal dimension.

The cutter itself includes a pair of motors, preferably hydraulic motors which are powered by the hydraulic power system, preferably located in the vehicle holding the boom which is preferably a standard track hoe. The motors rotate a pair of shafts which are secured to a drive sprocket. A drive chain is positioned around the teeth of the drive sprocket and a head sprocket to rotate a second shaft secured to the head sprocket. The second shaft rests in a pair of bearing hubs and rotates therein. The sprockets, chain and a portion of the second shaft are positioned within a case for environmental protection.

A drum is provided having bit holders positioned around the periphery thereof and secured thereto the bit holders holding therein cutter bits arranged around the drum in a helical formation. The cutter bits are formed from a very hard material, preferably a carbide such as, for example, silicon carbide or titanium carbide. The drum is secured to a shaft which is threaded at both ends by a pair of drum nuts, one at each end of the shaft, and rotates with the shaft.

In operation, hydraulic fluid is fed to the motors and causes rotation of the motor shaft from each motor. The shafts are secured to a drive sprocket, causing the drive sprocket to rotate and drive a drive chain which causes rotation of a head sprocket. Rotation of the head sprocket causes the shaft to rotate therewith and thereby rotate the drum, causing the cutter bits to rotate therewith. When the drums are rotating at desired speed, the positioning mechanism, which is well known, now positions the cutter against the desired location of a wall of rock or the like to be disintegrated. The wall is rapidly caused to disintegrate into small rocks which fall to the base of the wall and are easily removed. The cutter is continually repositioned, as required, to cause wall disintegration.

DESCRIPTION OF THE PREFERRED EMBODIMENT

Figure 1:
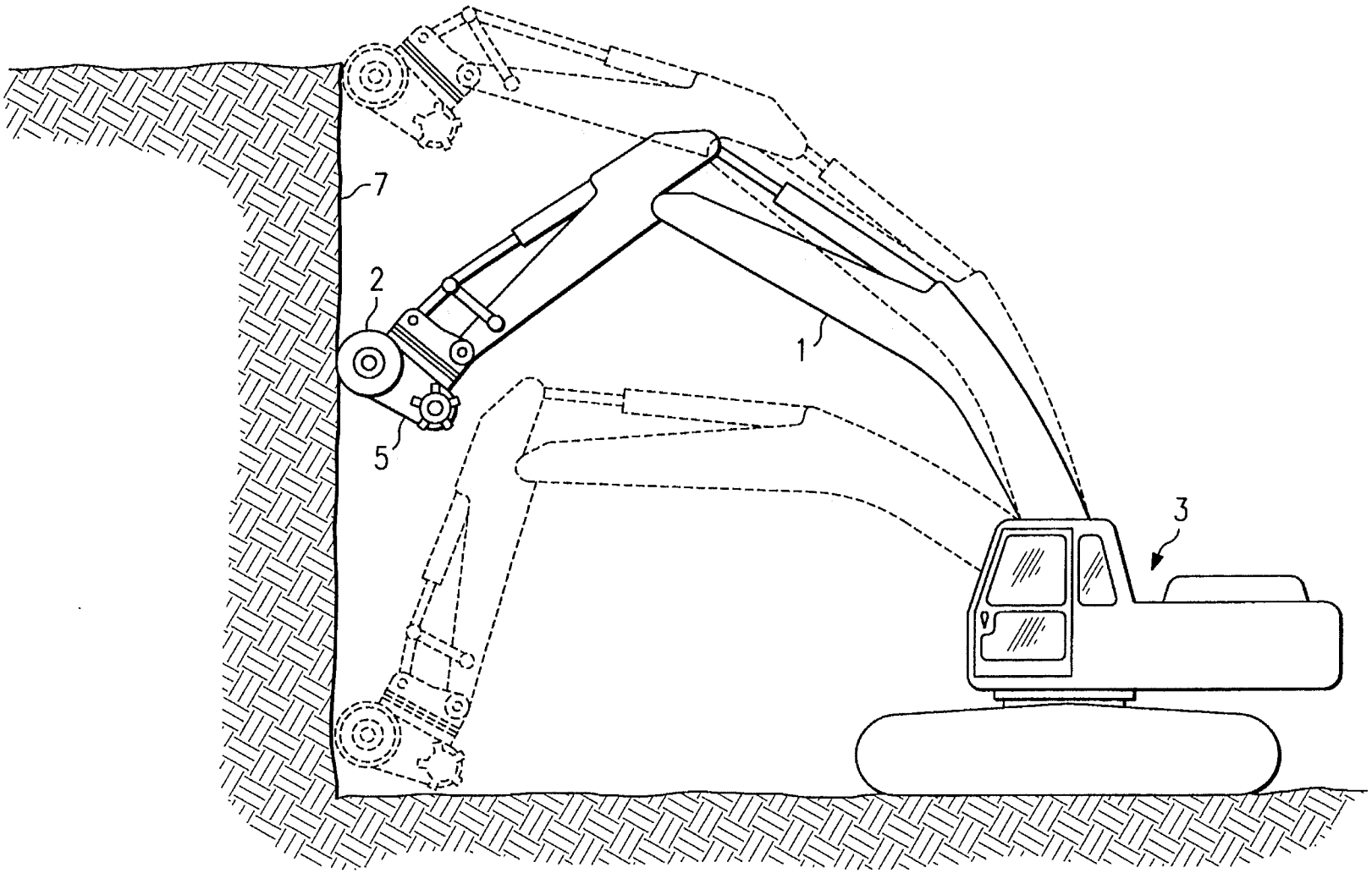
FIG. 1 is an elevational view of a cutter in accordance with the present invention with associated articulated boom and motive and hydraulic power system.

Referring first to FIG. 1, there is shown a standard articulating boom 1 which is hydraulically powered by a hydraulic power system (not shown) disposed in track hoe 3, the track hoe being capable of travel along the ground. The hydraulic power system powers hydraulic motors 14, 14A of FIG. 2 of the rotating stone cutter 5, the cutter being secured to the boom by a hanger mount and a pair of pins and nuts (22 shown). The articulating boom 1 and track hoe 3, under operator control from the cab of the track hoe, position the cutter 5 against a rock wall 7 or the like in three dimensions or with three degrees of freedom. More specifically, rotating cutter elements of the cutter 5 are placed in engagement with the wall of rock 7 and the cutter is moved up and down against the wall of rock, causing the wall to break down into pellets of rock which fall to the base of the wall and are later removed therefrom. The cutter positioning is accomplished by movement of the vehicle controlling the articulating boom in two horizontal dimensions as well as by operation of the boom itself which provides movement in a vertical and a horizontal dimension.

Figure 2:
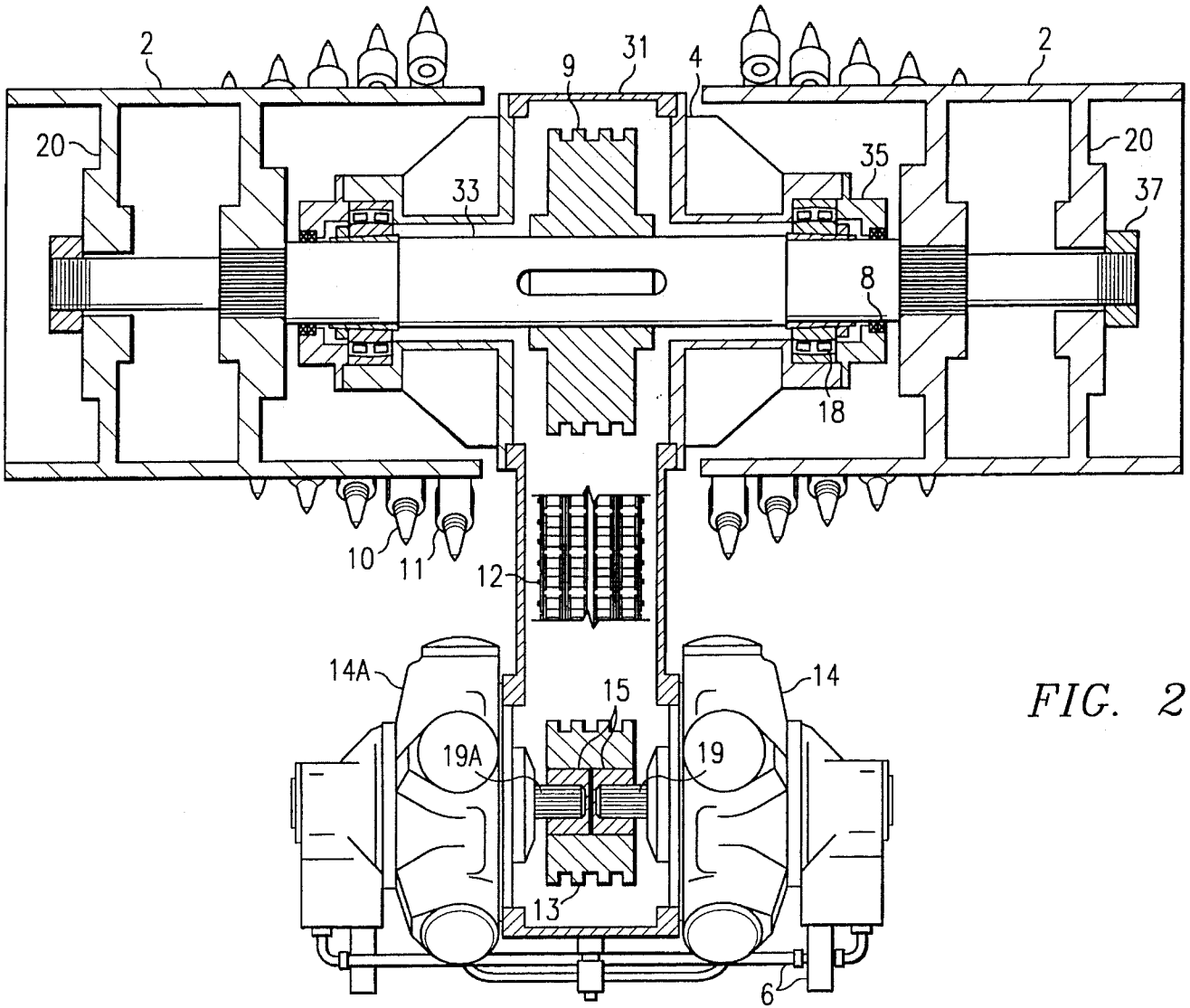
FIG. 2 is a partially cut away schematic diagram of the rotatable stone cutter in accordance with the present invention.

Referring now to FIG. 2, there is shown a diagram of the cutter 5. The cutter includes a pair of hydraulic motors 14 and 14A which are powered hydraulically from the track hoe 3 by hydraulic fluid entering at the manifold 6 and travelling to the motors. The manifold also provides for clockwise rotation of one motor and counter clockwise rotation of the other motor turning a common drive sprocket. Operation of the motors 14, 14A causes rotation of shafts 19, 19A respectively which are coupled to the motors. The shafts 19, 19A are secured to a drive sprocket 13 via a splined billet 15 in the hub of the drive sprocket. The drive sprocket 13 has teeth which engage a pair of drive chains 12, one associated with each motor, the chain links being positioned around the teeth of drive sprocket 13 as well as the teeth of a head sprocket 9 secured to a further shaft 33. Rotation of the chains 12 causes rotation of the shaft 33 which is secured to the head sprocket 9. The shaft 33 rests in a pair of bearing hubs 4 and rotates therein. A pair of bearing caps 35 retain the bearings 18 on which shaft 33 rotates within the bearing hub 4 and also serve as a seal holder for oil seals 8. The oil seals 8 are positioned so that they will allow the oil that is in the case 31 to lubricate the chains 12 and bearings 18 and not allow the oil to escape into the environment. The bearings 18 also act to keep the drive chain running true and carry the weight of the cutting mechanism while cutting. The sprockets 9 and 13, chain 12 and a portion of the shaft 33 are positioned within a case 31 for environmental protection.

A drum 2 has secured thereto, preferably by welding, bit holders 11 with bits or teeth 10 therein positioned around the periphery thereof, preferably in a helical arrangement. The preferred helical arrangement permits one tooth 10 at a time to cut the rock formation, thereby providing the maximum cutting pressure with the minimum amount of torque. The cutter bits 10 are fabricated from a very hard carbide, such as, for example, silicon or titanium carbide. The drum 2 is secured to the shaft 33 via a drum wall 20 by a pair of drum nuts 37, the shaft 9 being threaded at both ends and one such drum nut threadedly engaging the threads of the shaft 33 at each end of the shaft to secure the shaft 33 to the drum 2.

In operation, hydraulic fluid is fed to the motors 14, 14A via the manifold 6, causing rotation of the shafts 19 and 19A from each motor. This causes the splined billets 15 in the drive sprocket 13, and the drive sprocket to rotate. Rotation of the drive sprocket 13 drives chains 12 to cause rotation of the head sprocket 9. Rotation of the head sprocket 9 causes the shaft 33, which is secured to the head sprocket 9, to rotate therewith and thereby rotate the drum 2, causing the cutter bit holders 11 and cutter bits 10 therein to rotate therewith. When the drum 2 is rotating at desired speed, the positioning mechanism, which is well known and is discussed above, now positions the cutter 5 against the desired location of a wall of rock or the like to be disintegrated. The cutter teeth strike the wall of rock 7, one tooth at a time. The wall of rock 7 is thereby rapidly caused to disintegrate into small rocks which fall to the base of the wall and are easily removed. The cutter is continually repositioned against the wall of rock 7 by appropriate movement of the boom 1 and the track hoe 3, as required, to cause wall disintegration and rock pellet formation.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A system for crushing a wall of rock comprising:

(a) a track hoe having a motive system for providing motive power and movable with at least two degrees of freedom;

(b) an articulating boom secured to said track hoe and movable with at least two degrees of freedom, one of said two degrees of freedom being different from said two degrees of freedom of said track hoe; and (c) a separate rotating rock cutter removably secured to said articulating boom and powered by said motive system, said rotating rock cutter being movable in a vertical direction against said having a vertical component, said rock cutter comprising rotating drum means having a plurality of teeth on the surface thereof, said motive system providing motive power causing rotation of said drum about its axis.

2. The system of claim 1 wherein said motive structure includes a motor, a sprocket driven by said motor and a chain coupled to said drum.

3. The system of claim 2 wherein said motor is an hydraulic motor, further including a shaft secured to said chain and said drum means, said drum means including a first drum portion disposed on one side of said chain and a second drum portion disposed on an opposing side of said chain.

4. The system of claim 3 further including a plurality of tooth holders, one tooth holder associated with each of said plurality of teeth, for releasably securing a said tooth therein.

5. The system of claim 4 wherein each of said teeth is formed from a refractory carbide.

6. The system of claim 3 wherein each of said teeth is formed from a refractory carbide.

7. The system of claim 3 wherein said plurality of teeth are disposed on the surface of said drum in a helical array.

8. The system of claim 2 wherein said motive structure is an hydraulic motor.

9. The system of claim 8 further including a plurality of tooth holders, one tooth holder associated with each of said plurality of teeth, for releasably securing a said tooth therein.

10. The system of claim 9 wherein each of said teeth is formed from a refractory carbide.

11. The system of claim 10 wherein said plurality of teeth are disposed on the surface of said drum in a helical array.

12. The system of claim 8 wherein each of said teeth is formed from a refractory carbide.

13. The system of claim 9 wherein said plurality of teeth are disposed on the surface of said drum in a helical array.

14. The system of claim 2 further including a plurality of tooth holders, one tooth holder associated with each of said plurality of teeth, for releasably securing a said tooth therein.

15. The system of claim 14 wherein each of said teeth is formed from a refractory carbide.

16. The system of claim 2 wherein each of said teeth is formed from a refractory carbide.

17. The system of claim 1 further including a plurality of tooth holders, one tooth holder associated with each of said plurality of teeth, for releasably securing a said tooth therein.

18. The system of claim 17 wherein each of said teeth is formed from a refractory carbide.

19. The system of claim 1 wherein each of said teeth is formed from a refractory carbide.

20. The system of claim 1 wherein said plurality of teeth are disposed on the surface of said drum in a helical array.

* * * * *